US007284898B2

(12) United States Patent
Duell et al.

(10) Patent No.: US 7,284,898 B2
(45) Date of Patent: Oct. 23, 2007

(54) SYSTEM AND METHOD FOR MIXING WATER AND NON-AQUEOUS MATERIALS USING MEASURED WATER CONCENTRATION TO CONTROL ADDITION OF INGREDIENTS

(75) Inventors: Alan B. Duell, Duncan, OK (US); Keith E. Blaschke, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 342 days.

(21) Appl. No.: 10/797,220

(22) Filed: Mar. 10, 2004

(65) Prior Publication Data

US 2005/0201197 A1 Sep. 15, 2005

(51) Int. Cl.
*B01F 15/02* (2006.01)

(52) U.S. Cl. ..... 366/152.1; 366/136

(58) Field of Classification Search ..... 366/131–132, 366/134, 136–137, 152.1
See application file for complete search history.

(56) References Cited

U.S. PATENT DOCUMENTS

| | | | | |
|---|---|---|---|---|
| 3,563,517 A | | 2/1971 | Harriman | |
| 4,003,431 A | * | 1/1977 | Novotny et al. | 366/17 |
| 4,353,482 A | | 10/1982 | Tomlinson et al. | |
| 4,370,885 A | | 2/1983 | Alekhin et al. | |
| 4,488,815 A | | 12/1984 | Black | |
| 4,490,044 A | * | 12/1984 | Saito et al. | 366/17 |
| 4,654,802 A | | 3/1987 | Davis | |
| 4,881,819 A | | 11/1989 | Blees | |
| 4,930,576 A | | 6/1990 | Berryman et al. | |
| 4,976,546 A | | 12/1990 | Beattie | |
| 4,989,987 A | | 2/1991 | Berryman et al. | |
| 5,026,168 A | | 6/1991 | Berryman et al. | |
| 5,027,267 A | | 6/1991 | Pitts et al. | |
| 5,046,855 A | | 9/1991 | Allen et al. | |
| 5,114,239 A | | 5/1992 | Allen | |
| 5,190,374 A | | 3/1993 | Harms et al. | |
| 5,289,877 A | | 3/1994 | Naegele et al. | |
| 5,320,425 A | | 6/1994 | Stephenson et al. | |
| 5,365,435 A | | 11/1994 | Stephenson | |
| 5,382,411 A | | 1/1995 | Allen | |
| 5,426,137 A | | 6/1995 | Allen | |

(Continued)

FOREIGN PATENT DOCUMENTS

DE 19 21 681 A1 11/1970

(Continued)

OTHER PUBLICATIONS

DE 1921681 and English translation.*

(Continued)

*Primary Examiner*—Charles E. Cooley
(74) *Attorney, Agent, or Firm*—John W. Wustenberg; Baker Botts, L.L.P.

(57) ABSTRACT

The present invention is directed to a system and method for mixing a fluid comprising water and at least one non-aqueous material. The system comprises a mixing tub and mixing head adapted to inject the fluid into the mixing tub. It also includes a plurality of lines connected to the mixing head that supply the mixing head with water and the at least one non-aqueous material and a recirculation circuit that delivers the fluid from the mixing tub back to the mixing head. The system further includes a sensor connected to the recirculation circuit that measures the concentration of water in the fluid. An automatic controller uses the concentration measurement data to control the amount of each of the ingredients injected into the mixing tub.

11 Claims, 4 Drawing Sheets

U.S. PATENT DOCUMENTS

| | | | | |
|---|---|---|---|---|
| 5,522,459 | A | 6/1996 | Padgett et al. | |
| 5,537,914 | A | 7/1996 | Gibney et al. | |
| 5,538,341 | A | 7/1996 | Padgett et al. | |
| 5,570,743 | A | 11/1996 | Padgett et al. | |
| 5,775,803 | A | 7/1998 | Montgomery et al. | |
| 6,169,407 | B1 * | 1/2001 | Wang et al. | |
| 2002/0093875 | A1 | 7/2002 | Rondeau et al. | |
| 2003/0072208 | A1 | 4/2003 | Rondeau et al. | |
| 2003/0161211 | A1 | 8/2003 | Duell et al. | |
| 2005/0201197 | A1 * | 9/2005 | Duell et al. | 366/136 |

FOREIGN PATENT DOCUMENTS

| | | | |
|---|---|---|---|
| EP | 0 419 281 A2 | | 3/1991 |
| JP | 402171213 A | | 7/1990 |
| JP | 3-10662 | * | 1/1991 |
| WO | WO 02/44517 A1 | | 6/2002 |

OTHER PUBLICATIONS

SPE 71402 paper entitled "Innovative Solution For Cementing Across Formations With Very Low Fracture Gradients" by Christian Hun et al., 2001.

Article entitled "Light as a Feather, Hard as a Rock" by Abdullah Al-Suwaidi et al., pp. 2-15, Oilfield Review, Summer 2001.

Foreign communication from related counterpart application dated Jul. 15, 2005.

* cited by examiner

SYSTEM AND METHOD FOR MIXING WATER AND NON-AQUEOUS MATERIALS USING MEASURED WATER CONCENTRATION TO CONTROL ADDITION OF INGREDIENTS

FIELD OF THE INVENTION

The present invention relates generally to systems for preparing a mixture of a water and at least one non-aqueous material, and more particularly to a system and method for batch and continuous mixing of such materials using measured water concentration to control the addition of ingredients.

BACKGROUND OF THE INVENTION

In the drilling of oil and gas wells, it is often necessary to place cement or some other material around the outside of casing to protect the casing and prevent movement of formation fluids behind the casing. The cement is typically mixed in a mixer at the surface and pumped down hole and around the outside of the casing. The mixing is typically done by combining the cement ingredients, typically water, cement, and other non-aqueous materials until the proper density is obtained, and then continuing to mix as much material as needed at that density while pumping down hole in a continuous process. The process has been automated by most service providers so that automatic controls maintain the proper density during mixing. Density is of importance because the resulting hydrostatic pressure must be high enough to keep pressurized formation fluids in place but not so high as to fracture a weak formation. However, density is only one of several properties important to a cement slurry. Typical slurry densities range from 14 ppg (lbs/gal.) to 20 ppg.

In recent years, more need has arisen for light-weight slurries that can be used in wells with low fracture gradients, i.e., in formations that cannot support high hydrostatic pressures. These slurries may range in weight from 11 ppg to less than the density of water, which is 8.33 ppg. One method for making light-weight slurries is to add low specific gravity non-aqueous materials such as hollow glass beads to the dry materials to decrease the density. A drawback with such slurries is that below certain densities, the ratio of non-aqueous material to water can change significantly with only minor changes in density. Changes in the non-aqueous material-to-water ratio can affect slurry viscosity, compressive strength, and other properties. In these situations, density-based control systems do not work well.

Recent developments in processes to mix these light weight slurries involve the measurement of volumes rather than density in order to ensure the proper proportion of non-aqueous materials and liquids. This is done by measuring the volume of all liquids going into and out of the mixing tub using, e.g., a volumetric flow meter and also measuring the tub level. The volume of non-aqueous materials added to the mixing tub is not measured, but rather is calculated from the liquid volume and level measurements. The amount of non-aqueous materials and liquids in the mixture can thus be determined and hence controlled. Examples of this type of system are described in U.S. patent application Ser. No. 2002/0093875 A1 and International Patent Application No. WO 02/44517 A1. A system that purports to better control the density of slurries is also described in U.S. Pat. No. 5,775,803.

While the above described volumetric mixing systems generally work well, they have the disadvantage of adding equipment and flow lines to the mixing systems. Additionally, new control algorithms are needed to monitor the measurements and control the process. In many applications, particularly offshore, space is not available for the additional equipment. These systems also become less accurate as the size of the mixing tub increases, sometimes limiting their application.

SUMMARY OF THE INVENTION

The present invention is directed to a system and method that eliminates or at least minimizes the drawbacks of prior volumetric mixing systems.

In one aspect of the invention, the present invention is directed to a system for preparing a mixture, such as a cement, comprising water and at least one non-aqueous material. The system comprises a mixing zone; means for injecting water into the mixing zone; means for injecting the at least one non-aqueous material into the mixing zone; and a sensor disposed within the mixing zone that measures the concentration of water in the mixture. In another embodiment, the system according to the present invention comprises a mixing zone; means for injecting water into the mixing zone; means for injecting the at least one non-aqueous material into the mixing zone; a flow line through which the mixture is discharged from the mixing zone; and a sensor disposed within the discharge flow line that measures the concentration of water in the mixture.

In another aspect of the present invention, the present invention is directed to a method for preparing a mixture comprising water and at least one non-aqueous material. The method comprises the steps of combining the water and at least one non-aqueous material in a mixing zone; measuring the concentration of water in the mixture; and adjusting the amount of water and/or at least one non-aqueous material being combined in the mixing zone so as to obtain a desired water/non-aqueous material concentration. In another step, the mixture is discharged from the mixing zone. The concentration of water in the mixture may be measured either in the mixing zone or as the mixture is being discharged from the mixing zone.

The system and method according to the present invention has application in either a batch mixing process or a continuous mixing process. In a batch process, a tub of any volume can be mixed to the proper ratio of water and non-aqueous material, and then discharged. To accomplish a continuous mixing process, the mixing tub is initially filled with a mixture that has the proper ratio of water and non-aqueous material (solid or liquid) as measured by the concentration sensor. Then the mixture can be discharged from the mixing tub while simultaneously adding new ingredients to the mixing tub in a controlled manner that maintains the ratio of water and non-aqueous material in the tub, thus maintaining a continuous process. A continuous process allows the mixing of large volumes using a small mixing tub.

The advantages of measuring the water concentration directly include reduced pieces of operating equipment, smaller space required for operating equipment, lower cost, and simplified controls. The present invention thus provides a system that is less expensive and easier to retrofit on existing equipment. Additional features and advantages of the present invention will be readily apparent to those skilled in the art upon a reading of the description of the exemplary embodiments, which follows.

BRIEF DESCRIPTION OF THE DRAWINGS

A more complete understanding of the present disclosure and advantages thereof may be acquired by referring to the following description taken in conjunction with the accompanying drawings, which.

DETAILED DESCRIPTION OF THE INVENTION

Figure 1:
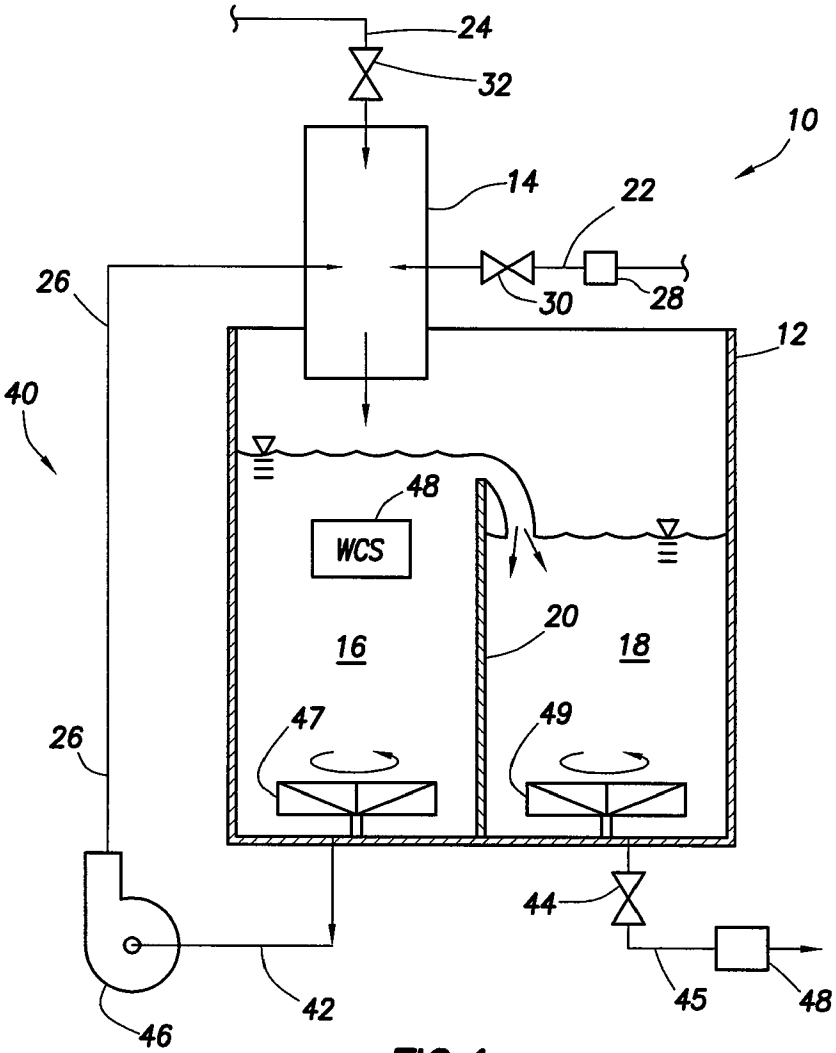
FIG. 1 is a schematic diagram of a system for mixing a fluid comprising water and at least one non-aqueous material in accordance with the present invention.

The details of the present invention will now be described with reference to the accompanying figure. Turning to FIG. 1, a system for mixing a fluid comprising water and at least one non-aqueous material is referred to generally by reference numeral 10. The system 10 comprises a mixing tub 12 and a mixing head 14. The mixing tub 12 has two compartments 16 and 18, which are separated by a weir 20. The mixing head 14 is placed over the first compartment 16, which is referred to as the pre-mix side. The fluid mixture, or slurry, is discharged from the second compartment 18, which is referred to as the down-hole side.

In one certain embodiment, the mixing head 14 is a Halliburton RCM II, RCM IIe, or RCM IIIr mixing head. As those of ordinary skill in the art will appreciate, however, other suitable mixing heads can be used. In its simplest embodiment, the mixing head 14 has three input ports for receiving inputs from flow lines 22, 24, and 26, respectively. However, as those of ordinary skill in the art will appreciate, the mixing head 14 may be adapted to receive inputs from additional flow lines.

Referring now to each individual flow line, flow line 22 is provided for injecting water into the mixing head 14. Water enters flow line 22 from an external source, such as a storage tank or other type of reservoir (not shown). In one certain exemplary embodiment, a flow rate sensor 28 is disposed within flow line 22. As those of ordinary skill in the art will appreciate, the flow rate sensor 28 can either be a volumetric flow meter or a mass flow meter or other similar known device. An actuator-controlled valve 30 may also be disposed within flow line 22 for controlling the amount of water being injected into the mixing head 14. Alternatively, a manually-controlled valve can also be used.

Flow line 24 is provided for injecting a non-aqueous material, such as a dry cement into the mixing head 14. The non-aqueous material is stored in a bulk storage tank or other type of reservoir (not shown). An actuator-controlled valve 32 may also be disposed within flow line 24 for controlling the amount of non-aqueous material being injected into the mixing head 14. Alternatively, a manually-controlled valve can also be used. Finally, flow line 26 injects recirculated fluid mixture into the mixing head 14. The recirculated fluid mixture is drawn from the first compartment 16 in the mixing tub, as will be further described below.

The system 10 further comprises a recirculation circuit 40. The recirculation circuit 40 comprises flow lines 42 and 26. Flow line 42 is connected at one end to a discharge port formed at the bottom of the first compartment 16 of the mixing tub 12. It is connected at the other end to an input port of a pump 46, which in one certain exemplary embodiment is a centrifugal pump. The flow line 26 is connected at one end to an output port of pump 46 and at the other to in input port of the mixing head 14. The recirculation circuit 40 further comprises a sensor 48, which measures the concentration of water within a fluid. The sensor 48 is disposed in flow line 26. However, as those of ordinary skill in the art will appreciate, the sensor 48 can also be disposed in discharge flow line 45 or elsewhere in the system where the mixture is present, such as the mixing tub 12. In one certain exemplary embodiment, the water concentration sensor is a Micro-Fluid LB 455 manufactured by Berthold Technologies. This sensor determines the amount of free water in a mixture by passing microwaves through the mixture and measuring phase shift and attenuation. It is capable of providing a process signal proportional to the water concentration or dry mass of the fluid mixture.

The system 10 further comprises a valve 44 disposed in flow line 45, which discharges the fluid mixture from the second compartment 18 of the mixing tub 12. The valve 44 can be either manually operated or actuator controlled, e.g., if used in an automated system. System 10 may further comprise agitators 47 and 49 disposed in each of the compartments 16 and 18, respectively. Agitators 47 and 49 can further assist/enhance the mixing of the fluid.

Figure 2:
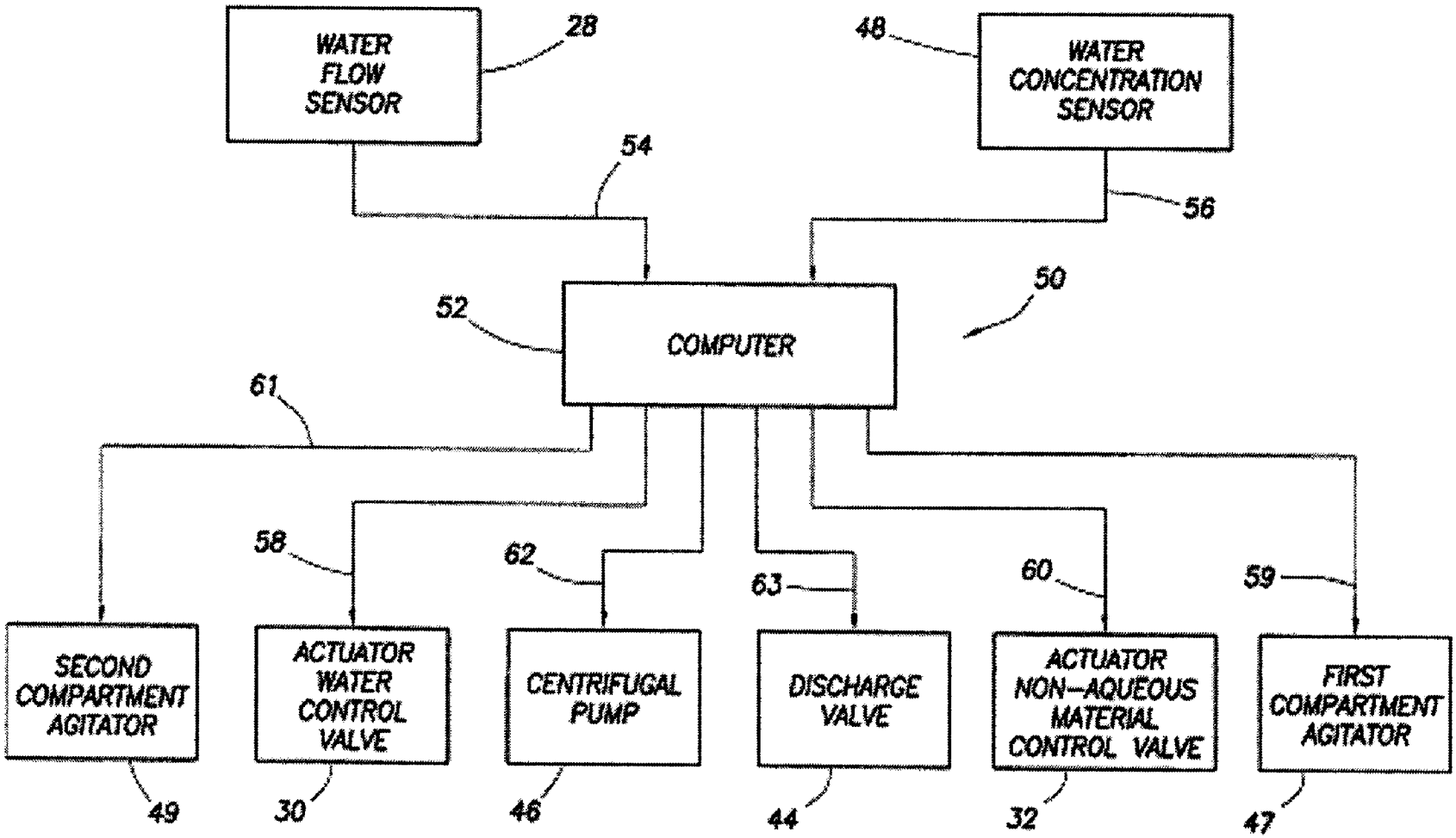
FIG. 2 is block diagram for an automatic control system for controlling the mixing system of FIG. 1.

The present invention further includes an automatic controller 50, which is shown in block form in FIG. 2. At the core of the automatic controller 50 is a computer 52, which takes input readings from the water concentration sensor 48 and flow rate sensor 28. Sensors 28 and 48 are connected to computer 52 via electric cables 54 and 56, respectively. The output of sensor 28 is a process signal indicative of either the volume or mass of water flowing through flow line 22. The output of sensor 48 is a process signal indicative of either the concentration of water or non-aqueous material flowing through flow line 26.

Computer 52 takes these readings and generates process control signals, which activate one or both of the actuators on the valves 30 and 32 via electric cables 58 and 60, respectively. The computer 52 compares the actual concentration of water or non-aqueous material in the fluid mixture to the desired amount and adjusts the amount of ingredients being added to the mixture accordingly. The rate at which non-aqueous material enters the mixing head 14 is not measured, but the rate is adjusted and controlled based on measurements from the water concentration sensor 48.

For example, if the concentration has too much water, the computer 52 may either reduce the amount of water being injected into the mixing head 14 or increase the amount of non-aqueous material being added or a combination of both. The computer 52 can use a PID (proportional integral derivative) control algorithm based program to control this operation or other similar program. As those of ordinary skill in the art will appreciate, the automatic controller 50 can utilize several different types of equipment. In one certain exemplary embodiment, a Halliburton UNIPRO II controller is used.

Figure 4:
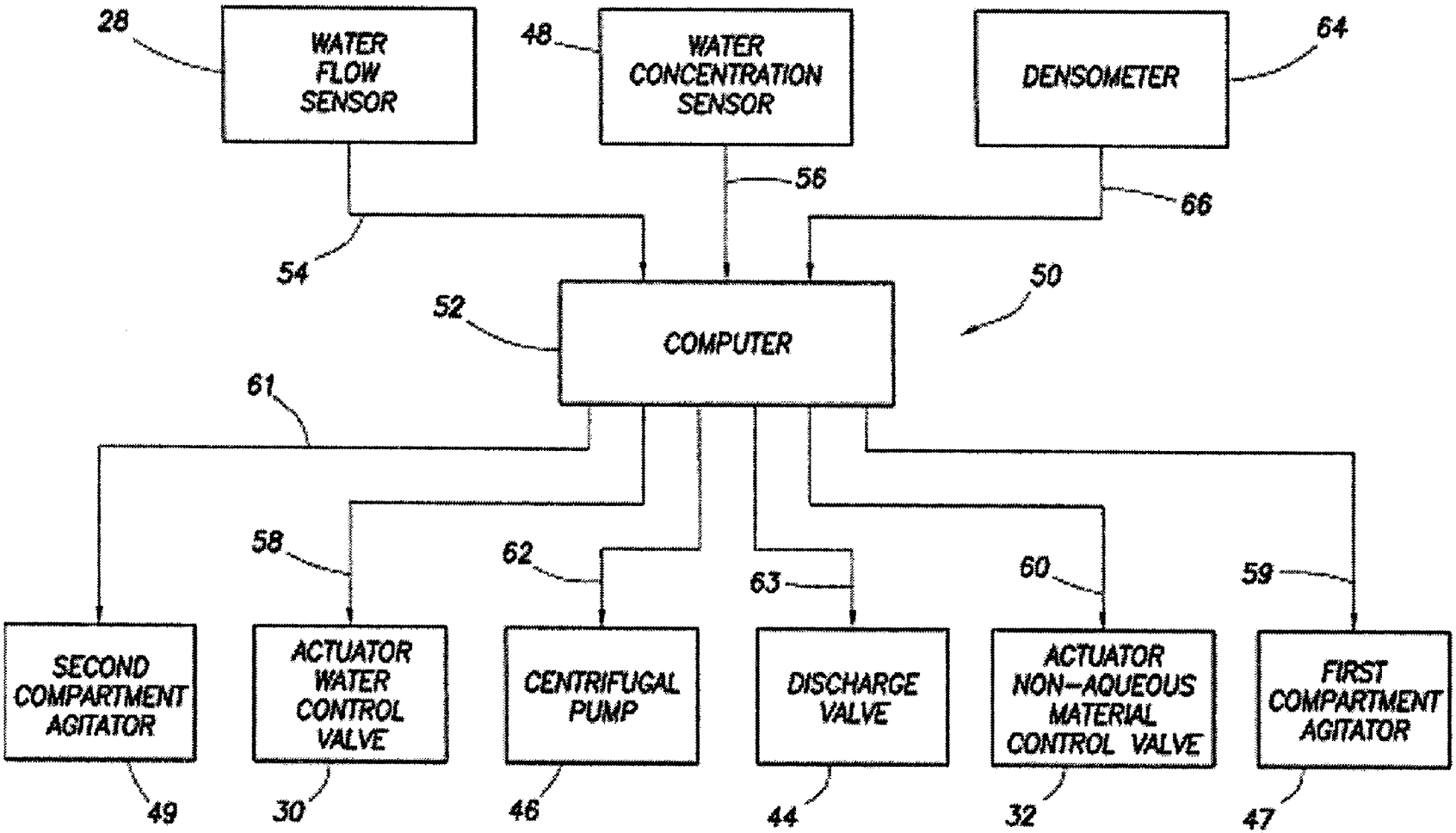
FIG. 4 is a block diagram of an automatic control system for controlling the mixing system of FIG. 3.

In one certain embodiment, the centrifugal pump 46 is manually operated. In another embodiment, it is controlled by the computer 52 via electric cable 62, as shown in FIGS. 2 and 4. In another embodiment, agitators 47 and 49 are manually operated. In another embodiment, they are controlled by computer 52 via electric cables 59 and 61, as shown in FIGS. 2 and 4. In yet another embodiment, valve 44 is manually controlled. In still another embodiment, it is controlled by computer 52 via electric cable 63.

Figure 3:
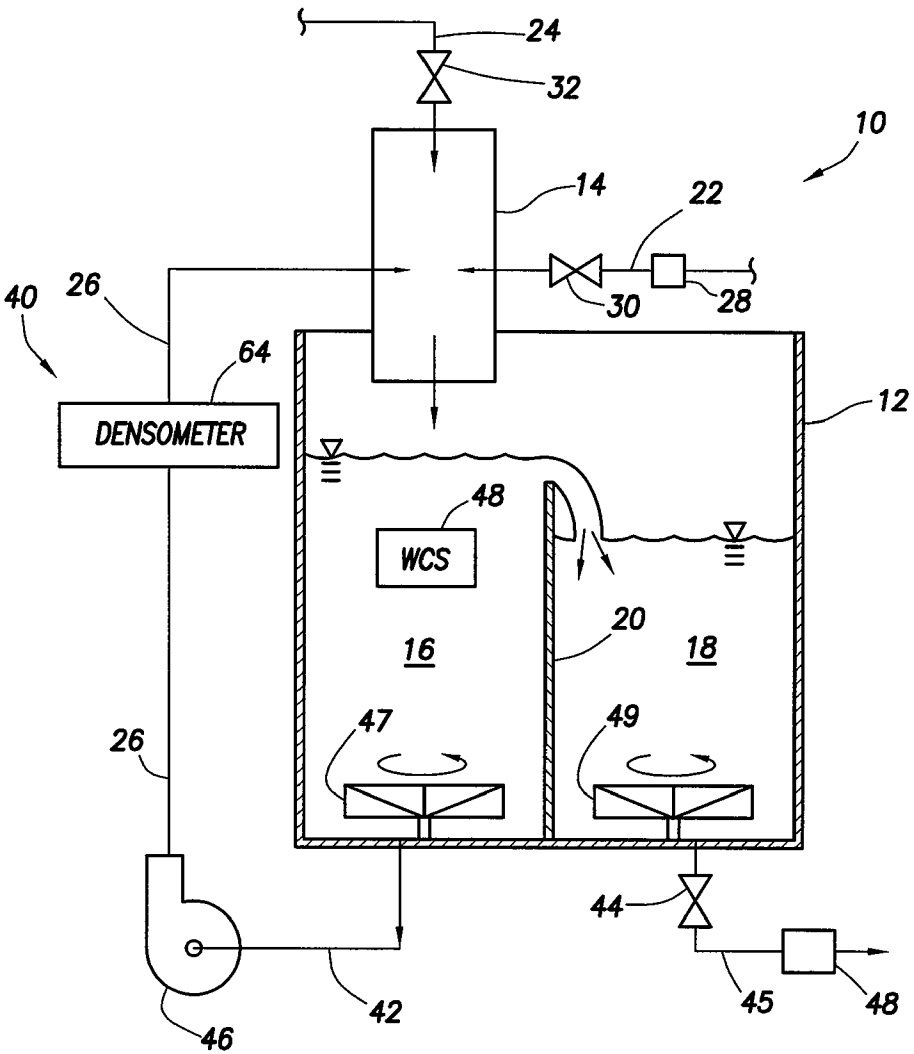
FIG. 3 is a schematic diagram of an alternate embodiment of the system shown in FIG. 1.

In one certain exemplary embodiment, the system 10 incorporates a water concentration sensor into a system similar to Halliburton's RCM recirculating mixing system. The RCM mixing system is disclosed in U.S. Pat. Nos. 3,563,517; 5,027,267; 5,046,855; and 5,538,341, which are hereby incorporated by reference. The RCM mixing system, as presented in these patents, incorporates a densometer, also known as a densitometer, and controls the mixing process based on density. In the present invention, the densometer is replaced with the water concentration sensor and the mixing process is controlled based on water or non-aqueous material concentration. Alternatively, both the densometer and water concentration sensor could be included in such a way that either or both devices could be used for control. Such an alternate embodiment is shown in FIGS. 3 and 4, which adds densometer 64 to flow control line 26. Electric cable 66 connects densometer 64 to the computer 52.

Figure 5:
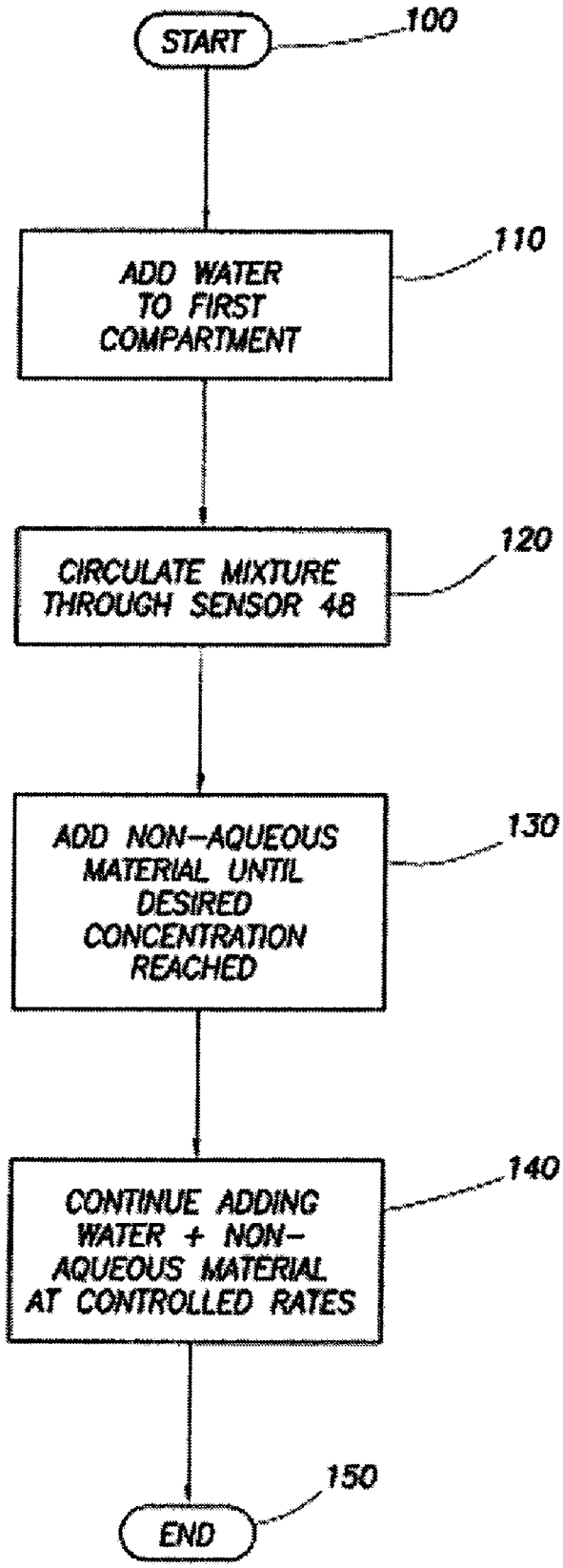
FIG. 5 is a flow diagram illustrating the steps in a process of mixing a fluid comprising water and at least one non-aqueous material in accordance with the present invention.

The method or process for mixing a fluid containing water and at least one non-aqueous material in accordance with the present invention will now be described with reference to the flow chart in FIG. 5. In step 100, the process is started. In step 110, the amount of water needed to make a mixture that will fill the first compartment 16 of the mixing tub 12 is added to the pre-mix side. In step 120, the contents of the first compartment 16 are then circulated through the recirculation circuit 40, and thus through the water concentration sensor 48. In step 130, non-aqueous material is added until the concentration of water (or non-aqueous material) in the mixture is at the desired value, as measured by the sensor 48. In step 140, water is continuously added through the mixing head 14 while simultaneously adding the non-aqueous material. The rate at which water is added is controlled to a pre-determined rate based on the rate at which the mixture, e.g., cement slurry is needed. The rate at which non-aqueous material is added is adjusted to maintain the proper water (or non-aqueous material) concentration as measured by the sensor. As water and non-aqueous material are added, the volume of mixture increases until it flows over the weir 20 into the second compartment 18 from which it can be discharged. Typically, in oil well applications the discharge would go to a pump (not shown), which would pump it down hole. The process is ended at step 150.

As should be evident to a person of ordinary skill in the art, the above process can be fully or partially automated, or not automated at all. In one example, activation of the pump 46 would not be automated, nor would activation of the discharge valve 44, agitator 47 and agitator 49. As pointed out above, activation of valves 30 and 32 can also be manual. In another embodiment, all the functions are automated, as shown in FIGS. 2 and 4.

As those of ordinary skill in the art will appreciate, the present invention has numerous applications. One such application is the mixing of oil field cement slurries. Other applications include, but are not limited to, the mixing of drilling fluids, fracturing fluids, and emulsions of water and non-aqueous liquids. Furthermore, many types and styles of mixers are known in the oil and gas industry, and many more can be conceived. Thus, this invention can be applied to other mixers and systems, as would be evident to those skilled in the art. Accordingly, while the invention has been depicted, described, and is defined by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A system for preparing a mixture of water and at least one non-aqueous material, comprising:

a mixing zone;

wherein the mixing zone comprises a mixing tub;

means for injecting water into the mixing zone;

means for injecting the at least one non-aqueous material into the mixing zone; and a sensor disposed within the mixing tub that measures the concentration of water in the mixture.

2. The system for preparing a mixture according to claim 1, wherein the injecting means further comprises a mixing head into which the water and at least one non-aqueous material are injected prior to being injected into the mixing zone and a flow line having a valve disposed therein that injects the water into the mixing head and a flow line having a valve disposed therein that injects the at least one non-aqueous material into the mixing head.

3. The system for preparing a mixture according to claim 2, wherein each of the valves is manually controlled.

4. The system for preparing a mixture according to claim 2, wherein each of the valves is controlled by an automatic controller, which is connected to the water concentration sensor.

5. The system for preparing a mixture according to claim 4, wherein each of the valves comprises an actuator connected to the automatic controller.

6. The system for preparing a mixture according to claim 5, further comprising a flow rate sensor disposed within the water flow line and wherein the flow rate sensor is connected to the automatic controller.

7. The system for preparing a mixture according to claim 6, wherein the automatic controller controls one or more of the actuators on the valves in response to signals received from the water concentration sensor and the flow rate sensor.

8. The system for preparing a mixture according to claim 5, wherein the automatic controller controls one or more of the actuators on the valves in response to signals received from the water concentration sensor.

9. The system for preparing a mixture according to claim 4, wherein the automatic controller comprises a computer.

10. The system for preparing a mixture according to claim 1, wherein the mixing tub comprises two compartments separated by a weir.

11. The system for preparing a mixture according to claim 10, further comprising an agitator in each of the compartments that mixes the water and at least one non-aqueous material.

* * * * *